US006319097B1

(12) United States Patent
Coverdale et al.

(10) Patent No.: US 6,319,097 B1
(45) Date of Patent: Nov. 20, 2001

(54) GRINDING METHODS AND APPARATUS

(75) Inventors: Stephen Roger Coverdale, Shipley; Michael Laycock, Keighley, both of (GB)

(73) Assignee: Unova U.K. Limited, Aylesbury (GB)

( * ) Notice: Subject to any disclaimer, the term of this patent is extended or adjusted under 35 U.S.C. 154(b) by 0 days.

(21) Appl. No.: 09/214,451

(22) PCT Filed: Jul. 23, 1997

(86) PCT No.: PCT/GB97/01993

§ 371 Date: Dec. 25, 1998

§ 102(e) Date: Dec. 25, 1998

(87) PCT Pub. No.: WO98/03303

PCT Pub. Date: Jan. 29, 1998

(30) Foreign Application Priority Data

Jul. 24, 1996 (GB) ..... 9615511

(51) Int. Cl.[7] ..... B24B 1/00

(52) U.S. Cl. ..... 451/49; 451/5; 451/72; 451/56; 451/65; 451/57; 451/913

(58) Field of Search ..... 451/49, 5, 72, 451/56, 65, 57, 913

(56) References Cited

U.S. PATENT DOCUMENTS

| | | | | |
|---|---|---|---|---|
| 4,224,768 | * | 9/1980 | Denney | 451/56 |
| 4,498,259 | * | 2/1985 | Yamamoto et al. | 451/5 |
| 5,562,526 | * | 10/1996 | Yoneda et al. | 451/9 |
| 5,766,059 | * | 6/1998 | Imai et al. | 451/49 |

FOREIGN PATENT DOCUMENTS

| | | | |
|---|---|---|---|
| 0 170 764 | | 2/1986 | (EP) . |
| 212473 | | 3/1924 | (GB) . |
| 1181156 | | 2/1970 | (GB) . |
| 1406203 | | 9/1975 | (GB) . |
| 2292329 | | 2/1996 | (GB) . |
| 2292704 | | 3/1996 | (GB) . |
| 54-114891 | * | 9/1979 | (JP) ..... B24B/5/42 |

* cited by examiner

*Primary Examiner*—Joseph J. Hail, III
*Assistant Examiner*—Shantese McDonald
(74) *Attorney, Agent, or Firm*—Lee, Mann, Smith, McWilliams, Sweeney & Ohlson

(57) ABSTRACT

The time to grind a workpiece can be reduced by selecting a grinding wheel whose width is not substantially greater than wheel strength considerations require, and which may therefore be less than the axial length of the region to be ground providing a work rest or work steady to increase the workpiece stiffness if required, and performing a succession of plunge grinding steps so as to grind the whole of the said axial region. Typically the grinding wheel is an electroplated CBN wheel, and the width of the grinding wheel selected is the narrowest permissible given the desired feed rate and motive power available. A grinding machine is disclosed comprising a wheelhead having mounted thereon a grinding wheel whose width is not substantially greater than that dictated by structural and strength requirements, programmable indexing means to enable the relative positions of the wheelhead and workpiece to be adjusted in a sequence of steps to achieve a sequence of plunge grinds, which may or may not overlap, to enable a region of the workpiece to be ground, the axial extent of which is greater than the width of the wheel, and wheel feed means and control means by which the feed rate is controlled, whereby the wheel feed rate is similarly programmable to enable a feed rate to be achieved which is limited only by the peak and RMS power capabilities of the wheel spindle drive motor, so that the rate of material removal is as high as is compatible with the power capabilities of the machine during each plunge, thereby optimising the total cycle time for grinding.

19 Claims, 4 Drawing Sheets

GRINDING METHODS AND APPARATUS

FIELD OF INVENTION

This invention concerns grinding methods and machines particularly techniques and modifications by which grinding efficiency can be improved.

BACKGROUND TO THE INVENTION

Removal of metal from a workpiece to define a ground region of a given axial length and diameter can be achieved by plunge grinding using a wheel whose width is equal to the axial length of the region to be ground, or by using a narrower wheel and progressively removing the material from the workpiece by axially traversing the workpiece relative to the wheel (or vice versa), or by using the narrow wheel and performing a series of adjacent slightly overlapping plunge grinds.

All other things being equal, and providing unlimited power is available, overall cycle time (ie the time from the initial engagement of the wheel and the workpiece to final disengagement after the region has been ground to size), will be least where a single wheel and single plunge is involved, although the need to regularly dress the wheel will increase the total machining time for a batch of workpieces to something in excess of the theoretical overall time.

SUMMARY OF THE INVENTION

According to one aspect of the present invention a method of optimising the grinding of a workpiece comprises the step of selecting a grinding wheel whose width is no larger than wheel strength considerations require and which may therefore be less than the axial length of the region of the ground providing a work rest or work steady if required to increase the workpiece stiffness and performing a succession of two or more plunge grinding steps so as to grind the whole of the said region.

In general it has been found that with conventional electroplated CBN grinding wheels, grinding efficiency increases as grinding wheel thickness is reduced, and structural strength of the wheel and/or workpiece stiffness will normally prevent a truly optimum solution to be obtained. However in terms of cycle time, surprisingly, the feed rates which can be achieved within a given motive power capability when using the narrowest permissible wheel and multiple plunge grinds with axial indexing, can still be significantly less than the cycle time when using a single wheel of sufficient width to permit the whole axial extent of the region to be ground with a single plunge grind.

The invention also lies in a method of grinding an axial region of a workpiece using a grinding wheel whose width is not substantially greater than that dictated by structural and strength requirements, mounted on a wheelhead, comprising the steps of programming wheelhead and/or workpiece indexing drive means to enable the relative positions of the wheelhead and workpiece to be adjusted in a sequence of steps to achieve a sequence of plunge grinds, which may or may not overlap, to enable the said axial region of the workpiece to be ground, the axial extent of the said axial region being greater than the width of the wheel, programming a computer based machine control system to generate control signals for controlling the rate of wheel feed during grinding dependent on feedback signals during grinding, and entering data into dat stores associated with the control system relating to maximum instantaneous and RMS power of the wheel spindle drive motor, and controlling the wheel feed rate by the control system to enable a feed rate to be achieved limited only by the peak and RMS power capabilities of the wheel spindle drive motor, so that the rate of material removal is as high as is compatible with the power capabilities of the machine during each plunge, thereby optimising the total cycle time for grinding, wherein the feedback signals enable each of the instantaneous, and RMS, wheel spindle motor power, to be calculated as grinding progresses.

The invention also lies in a method as aforesaid wherein the wheel feed programming includes the steps of inputting parameters such as grinding wheel material, workpiece material, workpiece cutting speed, coolant composition, grinding wheel feed per workpiece revolution limit, maximum instantaneous and RMS wheel spindle drive motor power, and grinding wheel cutting speed.

The method may include the step of gauging the diameter of the workpiece during or after grinding. Information relating to the diameter may be supplied to a controlling computer and the workpiece speed of rotation may be adjusted in dependent on the gauged diameter.

The invention also lies in methods as aforesaid wherein the plunge grinds are performed using the same wheel.

The invention also lies in methods as aforesaid wherein the plunge grinds are performed using two or more wheels.

The invention generally envisages that each wheel is used in turn so that only one wheel is engaging the workpiece at any time but where power capability exists, two or more of the wheels may be engaged simultaneously.

The invention is of particular application in the grinding of workpiece regions which contain annular shoulders at one or both ends of the region, with or without an undercut or radius adjacent one, or both, shoulders.

According to another aspect therefore of the invention, a method of grinding a region between or to form shoulders comprises the step of plunge grinding adjacent one of the shoulders using a wheel whose width is less than the axial distance required there-between, indexing and plunge grinding adjacent the other shoulders with the same grinding wheel, and thereafter removing any unground material remaining between the two shoulders by performing one or more plunge grind steps with appropriate indexing.

Where a single additional plunge grind is needed to remove unground material, the indexing preferably registers the wheel centrally over the unground sections.

Where two additional plunge grinds are required to remove the unground material, the indexing preferably registers the wheel so as to remove approximately equal widths of the unground material during each of the two additional plunge grinds so that uniform wheel wear can be achieved by alternating which of the two parts of the unground region is ground first by the additional plunge grinds, as between one workpiece and the next, when a succession of similar workpieces are to be ground in this way.

Where three (or more) additional plunge grinds are required, the indexing is preferably such as to present the wheel to the workpiece so that unground material makes contact with one side of the wheel substantially the same number of times in the sequence of additional plunge grinds as the other side of the wheel is presented with unground material.

According to a further aspect of the invention in a method of grinding a workpiece with a grinding wheel, selected as aforesaid and whose width is less than the axial extent of the region to be ground, at least one of the additional plunge grinds required to grind the whole of the said region is performed by a second grinding wheel also selected as aforesaid.

This said further aspect of the invention is of particular application to the grinding of workpiece regions which have an annular shoulder at at least one end, and which require one or more annular profiles such as undercuts or grooves or annular radial protrusions, to be ground in the surface of a region using appropriately formed wheel profiles.

Where a single such annular profile is to be formed it is preferably generated using a narrow formed grinding wheel (selected as aforesaid) which grinds the annular profile and adjacent parts of said region, and the remainder of the region is ground using one or more additional grinding wheels by an appropriate number of plunge grinds.

Where two such profiles are required, for example one at each end of the said region, the grinding may be performed by plunge grinding one end using a first narrow formed wheel (selected as aforesaid), plunge grinding the other end using a second narrow formed wheel (also selected as aforesaid) and if any further material remains to be ground between those sections which have been ground by the first and second wheels, grinding the further material by one or more plunge grinds using one or more plain grinding wheels. By "plain" is meant a cylindrical grinding wheel which is rotated about an axis which is coaxial with the axis of the cylindrical grinding surface and the latter when viewed tangentially appears flat and plain (ie it possesses the same diameter across the whole width of the cylindrical grinding surface).

A particularly preferred aspect of the invention is one in which two undercuts are to be formed adjacent two annular shoulder at opposite ends of a cylindrical region and according to this aspect of the invention a first grinding wheel having an appropriate formed grinding surface is engaged with one end of the said region so as to grind the undercut and surface grind part of the adjacent cylindrical surface and a second grinding wheel is employed to grind the other undercut and the remainder of the cylindrical surface between the two undercuts.

The two wheels may have the sane or different widths but in either event the total width expressed as the sum of the two widths, should be not less than the total width between the shoulders.

Preferably the sum of the two wheel widths is just greater than the axial spacing between the two shoulders.

Where the workpiece comprises a crankshaft and the region being ground is a crankpin, typical dimensions are such that the cycle time can be significantly reduced by using two such wheels, since the axial extent of the pin regions of the cranks is such that the sum of the widths of two relatively narrow wheels will still be greater than the axial extent of the pin.

Where full optimisation requires narrower wheels to be used (and such wheels are still strong enough to be used), this can result in an axial region being left in the middle of the pin, which then has to be removed by plunge grinding using one or more plain grinding wheels, but the overall cycle time may still be significantly less than that if a single formed wheel is used albeit at reduced feed rates to accommodate the power capabilities of the given grinding machine.

It may be advantageous to use one or more minimum width grinding wheels and multiple plunge grinds to grind the whole of the cylindrical surface between the shoulders as a first operation and to use a single wide profiled grinding wheel to grind the two undercuts as a second operation, the diameter of the wide grinding wheel being such that its surface between the two annular profiles which will grind the undercuts, makes no contact with the ground surface between the undercuts (or is merely used to polish the ground surface during spark-out as the grinding of the two undercuts is completed and this intermediate cylindrical surface just makes grazing contact with the previously ground surface between the two undercuts.

In the first said operation the width of the material being ground is limited by the minimum width of the grinding wheel but the cycle time can be optimised using multiple plunge grinds with high metal removal rates without exceeding the power capability of the grinding machine. During the second operation in which the undercuts are ground, the actual width of grinding wheel which is in contact with the workpiece is limited to the width of the two undercuts, the rest of the wheel merely serving as a structural support for these two narrow annular profiles around the wheel. As a consequence, since the intermediate region of the profiled wheel is not performing any grinding, the effective width of the wheel is now the sum of the widths of the two annular profiles producing the undercuts and again high metal removal rates can be achieved without overloading the power capabilities of the machine.

Where two or more grinding wheels are required to plunge grind and finish a given region, the wheels may be introduced one after the other into the region, or may be located at different positions along a grinding machine bed and the workpiece is indexed so as to present the region to each of the different wheels at different times. The indexing is preferably controlled so as to present appropriate parts of each region to appropriate grinding wheels.

It is often desirable to enable a single grinding machine to be modified so as to grind different workpieces. In the case of crankshafts, different crankshafts will typically have different diameters and axial lengths of crankpins and where methods according to the invention are employed, the use of a single profiled wheel to produce two undercuts, one at each end of each crankpin, will require a different formed wheel to be substituted to allow different crankshafts to be ground.

According to a further preferred aspect of the invention, two profiled grinding wheels may be used in place of a single profiled wheel, each of which includes a cylindrical surface (which may or may not be used in the grinding process to remove metal) and an annular region of greater diameter (referred to as an annular profile), which is intended to engage the ground cylindrical surface and form the undercut therein. By selecting the narrowest possible width wheels and mounting the wheels on a common shaft, so all the benefits of the aforementioned method can be achieved and alteration of the axial spacing between the undercuts is achieved by simply altering the spacing between the two wheels mounted on the shaft.

In an alternative and preferred arrangement, the wheels are mounted on separate shafts (which may or may not be driven by the same motor), and one or both of the two shafts are adjustable in position so that the axial spacing between the two wheels can be altered, thereby adjusting the distance between the two undercuts to be formed by the two wheels.

Where the wheels are mounted on separate shafts, these may be positioned such as to enable both wheels to simultaneously plunge grind the two undercuts, but it may be more advantageous to locate the two wheels on different wheelheads and index the workpiece (or the wheelhead assembly) so as to grind with first one and then the other of the two profiled grinding wheels.

Where only two grinding wheels are to be employed, and a range of adjustment of the spacing between annular profiles is to be optimised provided for and ideally made as large as possible, it is probable that both of the wheels should have the same width. The minimum spacing between the two profiles is then equal to the width of one wheel and the maximum spacing is equal to the sum of the widths of the two wheels, ie a range of 2:1.

The invention also lies in apparatus for performing the aforementioned methods.

In one embodiment, a grinding machine includes a single wheelhead having mounted thereon a grinding wheel whose width is not substantially greater than that dictated by structural and strength requirements, and programmable indexing means is provided to enable the relative positions of the wheelhead and workpiece to be adjusted in a sequence of steps to achieve a sequence of plunge grinds, which may or may not overlap, to enable a region of the workpiece to be ground, the axial extent of which is greater than the width of the wheel, and the wheel feed means is controlled by feed rate control means, wherein the wheel feed rate is programmable to enable the feed rate to be increased up to the maximum permitted given the peak and RMS power capabilities of the wheel spindle drive, so that the rate of material removal is as high as is compatible with the power capabilities of the machine during each plunge, thereby optimising the total cycle time for grinding.

The grinding machine aforesaid may further comprise means for gauging the diameter of the workpiece during, or after, grinding and means for generating an electrical signal indicative of the diameter for supply to the computer based control system.

The invention also provides a machine as aforesaid when programmed so as to achieve the said optimal cycle time.

The wheel feed programming capability preferably includes adjustable but essentially preset parameters such as maximum motor power and RMS motor power, and other parameters such as grinding wheel material, workpiece material and workpiece condition (ie current wheel diameter) can be inserted by the operator.

Workpiece condition can be maintained and the process further optimised by sensing the wheel diameter (which reduces as the wheel becomes worn), and adjusting not only wheel feed but also wheel feed rate to take account of the increasingly smaller diameter as the wheel becomes worn. The invention envisages a machine as aforesaid when fitted with wheel diameter sensing means and feedback control means for adjusting the wheel feed are wheel feed rate accordingly.

Since rate of cooling achieved by coolant may also be an important factor, a signal may also be generated for and means provided, responsive thereto for controlling the coolant fluid pump so that the latter is operated at an appropriate level as called for by the expected material removal rate. Where the overall power for a machine is governed by the combination of coolant fluid pump and wheelhead power, the computation of the wheel feed rate preferably includes taking into account the power required for the coolant pump.

In another embodiment of the invention, the grinding machine includes two narrow grinding wheels mounted on a single spindle for simultaneous engagement with a workpiece to perform plunge grinds at accurately spaced apart positions on a workpiece.

According to a further aspect of the invention the grinding machine includes two narrow wheels mounted on separate spindles, each of which is mounted for independent movement towards and away from a workpiece.

The two wheels may be mounted at a fixed spacing relative to each other, or may be adjustable in position so that the spacing between the wheels (measured generally parallel to the workpiece axis) can be adjusted.

Adjustment of the axial spacing may be during set-up to allow for different axially spaced regions of a workpiece to be addressed or may be such as to permit traverse grinding, and/or indexing, to permit a sequence of plunge grinds to grind surface.

The invention also lies in apparatus for grinding comprising a first grinding wheel having a profiled grinding surface, wheel dressing means associated therewith for dressing the grinding wheel as required to maintain the profile thereon, means for advancing and retracting the first grinding wheel towards and away from a workpiece so as to form an annular profile in the grinding surface and optionally to surface grind at least an adjacent region of the workpiece surface, a second grinding wheel mounted independently of the first grinding wheel and adapted to be brought into engagement with the workpiece to grind an adjacent region of the workpiece surface within which the profile has been formed by one or more plunge grinds.

The second grinding wheel may also include wheel dressing means.

Where a second profile is to be formed in the workpiece surface a fixed distance from the first profile and the distance between the profiles is no greater than the combined widths of the two wheels, the second grinding wheel may also include a profiled grinding surface so as to form the second desired annular profile in the workpiece surface during grinding thereof by the second grinding wheel. By providing for independent movement of the two grinding wheels, so first one and then the other may be brought into grinding contact with the workpiece so that the full machine power is available for each of the two plunge grinding steps, thus enabling a high rate of material removal to be achieved.

Where the axial extent of the workpiece surface which is to be ground is greater than the sum of the two grinding wheel widths, the second grinding wheel may be indexed so as to perform a sequence of plunge grinds assuming that it is not profiled. Where the second wheel is also profiled, the two extreme plunge grinds may be performed leaving an intermediate region to be removed by a third plain grinding wheel which may be operated so as to perform a single plunge grind or a sequence of plunge grinds so as to remove the said intermediate region.

Wherever possible the width of each grinding wheel is selected so as to be as close as possible to the minimum permitted given strength and rigidity considerations and wheel feed is adjusted so as to thereby optimise the power available within the machine for grinding and obtain the maximum rate of material removal for the power and grinding medium available.

The invention will now be described, by way of example, with reference to the accompanying drawings, in which.

Figure 4:
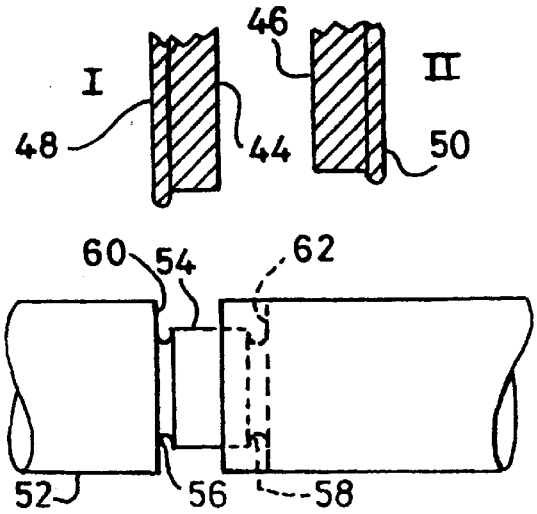
FIG. 4 shows has two narrower profiled grinding wheels can be used in accordance with the invention to grind the same region as the twin profiled wheel of FIG. 3, and under some circumstances achieve a higher grinding speed.
Figure 6:
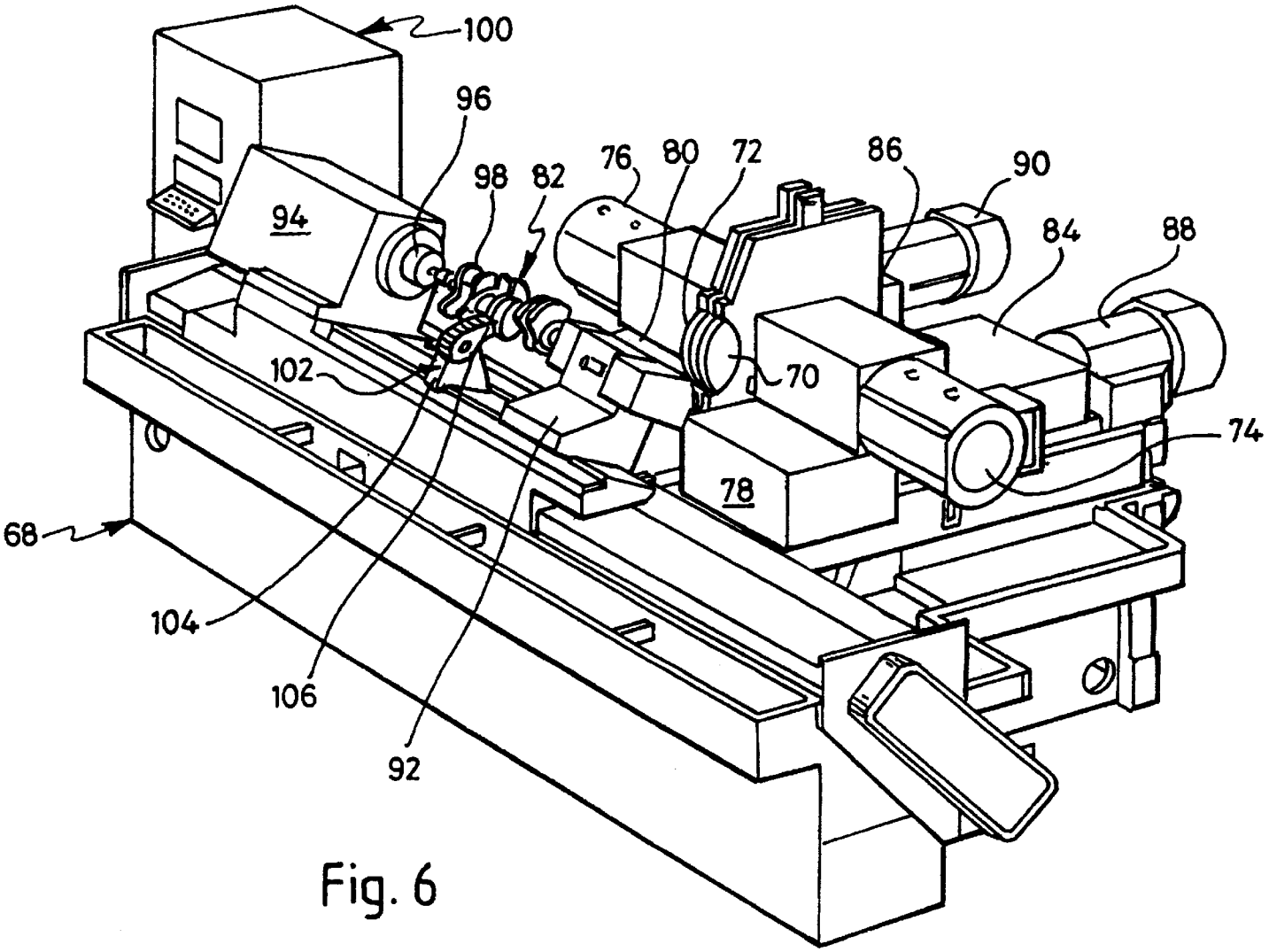
Figure 7:
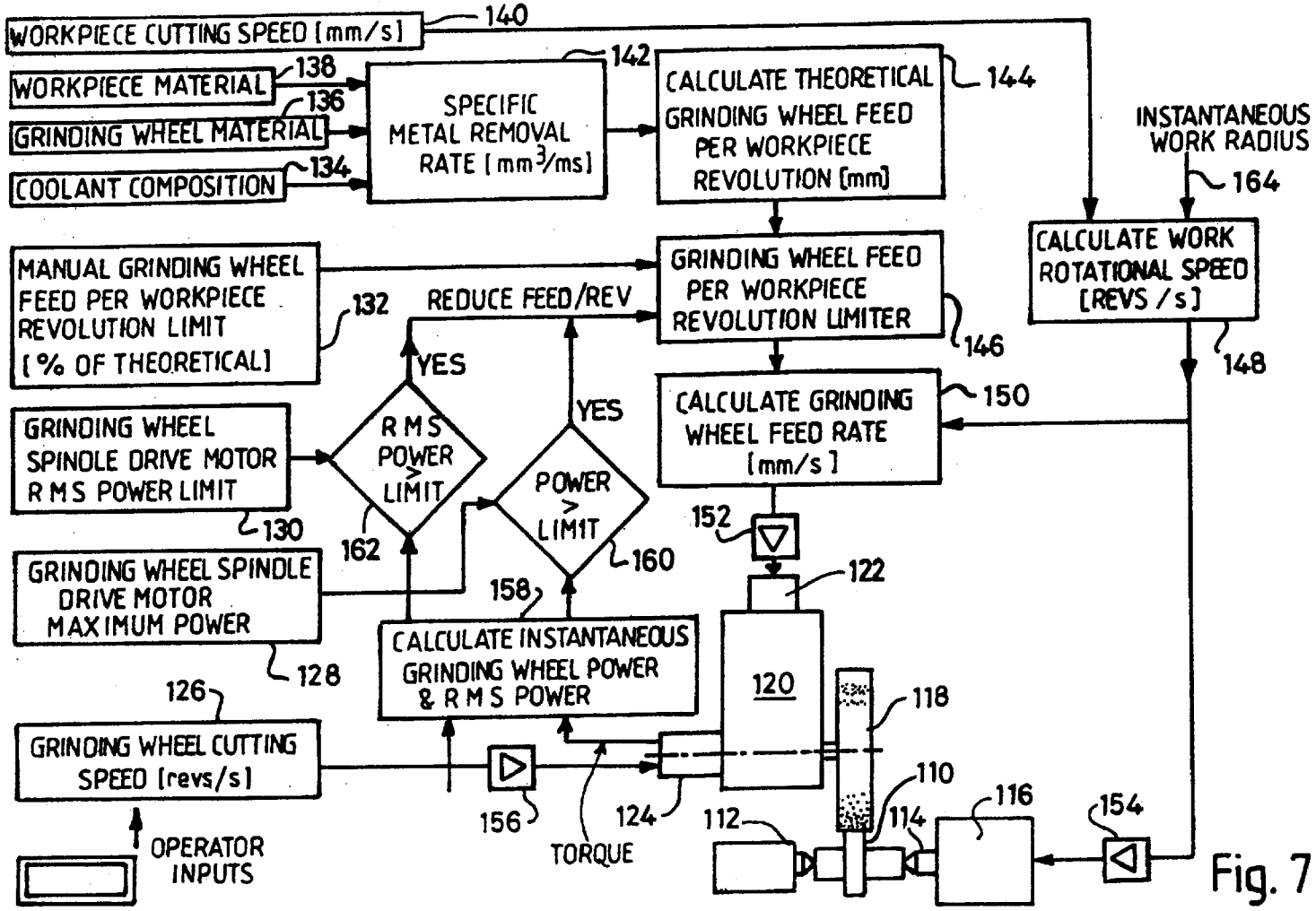

FIGS. 5A, B and C show how three different grinding wheels each selected to allow optimal material removal per plunge given a fixed power capability of the machine, can be used to grind a similar region to that shown in FIG. 4 but of greater axial extent than is possible using two profiled grinding wheels such as in FIG. 4;

FIG. 6 is a perspective view of a computer controlled grinding machine fitted with two independently controllable narrow gauge grinding wheels; and FIG. 7 is a control system functionality listing showing the data inputs and programme decisions required to achieve optimal material removal per plunge grind.

DETAILED DESCRIPTION OF DRAWINGS

Figure 1:
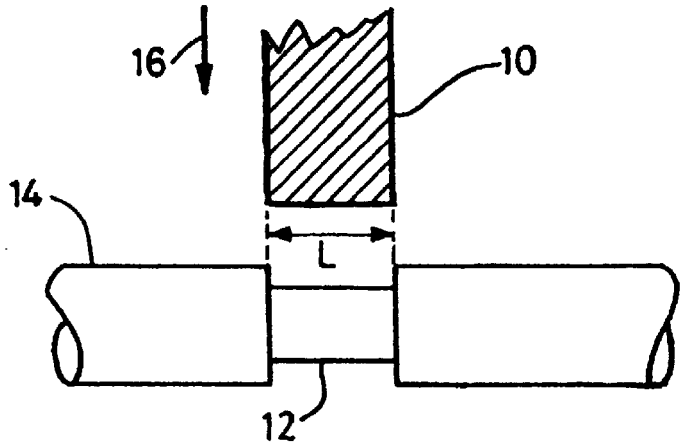
FIG. 1 shows a conventional plunge grind using a wide wheel.

FIG. 1 shows a conventional plunge grinding technique. Here a grinding wheel 10 is shown aligned with the region 12 of a workpiece 14 which has been ground by plunging the wheel 10 into the workpiece 14 in the direction of the arrow 16 by a distance equal to the change in radius as between the larger diameter 14 and the smaller diameter 12.

If the axial distance between the shoulders at opposite ends of the reduced diameter region 12 is L, then it has hitherto generally been assumed that the minimum time for grinding is obtained by selecting a single grinding wheel of width L and performing a single plunge grind.

If unlimited power and infinite workpiece stiffness workpiece and machine supports etc can be assumed, then this conventional approach would produce the minimum grinding time. However it has been discovered that increasing the wheel width requires disproportionately greater increases in power to match the material removable capabilities of narrower wheels using the same grinding material, and if unlimited power is not available, and in particular if the RMS power requirement is significantly limited, the feed rate achievable, (ie the rate at which the wheel 10 is advanced in the direction of arrow 16) reduces significantly as the wheel width increases. Whilst a greater axial length of workpiece is addressed by a wider wheel, the volume of material removed per second can in fact be less than if the same power is available to drive a narrower wheel.

Figure 2:
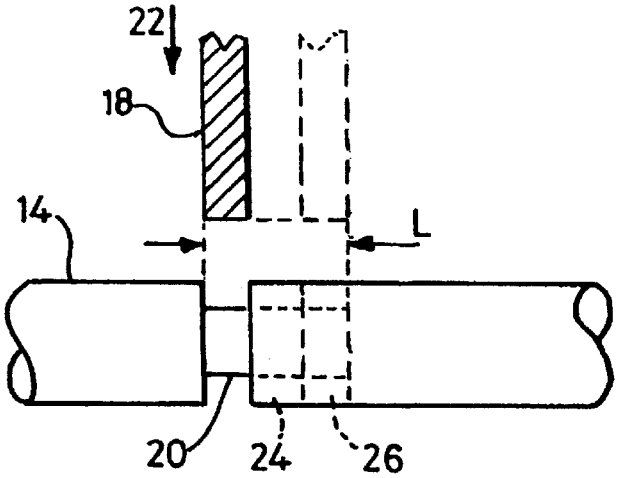
FIG. 2 shows how a sequence of plunge grinds using a narrow wheel can remove material over the same axial extent as the wider wheel and under some circumstances obtain a faster grinding time.

FIG. 2 illustrates the principle of the invention. Here the grinding wheel 10 is replaced by a narrower grinding wheel 18 the thickness of which is approximately one third that of the wheel 10. A single plunge grind of the wheel 18 will produce a reduced diameter section 20 which if the feed in the direction of arrow 22 in FIG. 2 is the same as the distance through which wheel 10 is moved, will result in the same final diameter for the region 20 as is the diameter of region 12.

In accordance with the invention, the wheel 18 is now retracted in the opposite direction of arrow 22 and either the wheel or the workpiece indexed (or both) so as to present another region of the workpiece 14 for grinding, after which a second plunge grind is performed so as to remove one or other of the regions denoted in dotted outline at 24 and 26.

Subsequent indexing allows the remaining region to be removed by a third plunge grind.

In order to obtain more uniform wheel wear, regions such as 26 are preferably plunge ground before region such as 24, so that each of the flat surfaces of the wheel 18 is subjected to the same number of interactions with unground material as is the other.

In order to ensure full removal of material, the actual thickness of the wheel 18 should be just greater than one third of the distance L.

By aligning the left hand edge of the wheel 18 with the left hand end position of the region 20 which is to be ground, the first plunge grind will remove just over one third of the distance L. By then aligning the right hand edge of the wheel 18 a distance L from the shoulder formed by the first plunge grind, a second plunge grind will remove material from the opposite end of the region 20 over a distance equal to just over one third of the length L measured from the right hand shoulder. This leaves an annular upstand in the middle which is somewhat less than one third L in axial extent and is equidistant from each of the two shoulders at opposite ends of the region 20. This annulus of unwanted material can then be removed by a single plunge grind by centering it and the wheel 18 and performing the third plunge grind.

Figure 3:
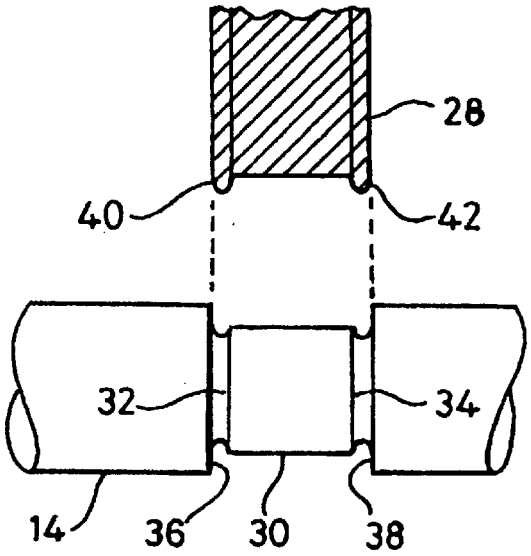
FIG. 3 shows a conventional twin profiled grinding wheel for grinding a workpiece in a plunge grind mode as shown.

If one of the ends of the region 20 is to be formed with an annular profile such as an undercut, then a second wheel (not shown) may be used to perform the plunge grind in the region in which the undercut is required, but the other region or regions in which an undercut is not required can be removed using a plain grinding wheel such as that shown at 18 in FIG. 2.

Where two undercuts are required such as at opposite ends of a crankpin such as shown in FIG. 3, it has been conventional to employ a twin profiled grinding wheel such as shown at 28 in FIG. 3. A wheel dressing device (not shown) is provided to produce and regularly maintain/reinstate the external peripheral profile of the wheel 28, and a single plunge grind will result in a ground region in the workpiece 14 made up of a cylindrical pin surface 30 having a diameter less than the diameter of the adjoining regions of the workpiece 14, with two undercuts 32 and 34, one at each end between the reduced diameter pin 30 and the shoulders 36 and 38. With use, the profile 40 and 42 on the grinding wheel 28 which produce the undercuts 32 and 34 become worn and it is necessary in practice to frequently re-shape the wheel 28 so as to ensure that the correct depth of undercut is achieved.

FIG. 4 shows how the region 30 of FIG. 3 can be ground in accordance with the invention using two narrower grinding wheels 44 and 46 each containing an edge profile 48 and 50 respectively for grinding an undercut. The method involves plunge grinding using the first grinding wheel 44 so as to grind the first half of a reduced diameter section 54 of the workpiece 52, with an undercut 56. The wheel 44 is then withdrawn and by appropriate relative movement, the second wheel 46 is aligned with the other part of the region to be ground. Using a second plunge grind, the region shown in dotted outline is now ground so as to complete the grinding of the region 54, with a second undercut at 58. The width of each of the two grinding wheels 44 and 46 (including the profiled region 48 and 50 in each case), is just a little in excess of 50% of the axial distance between the two shoulders or cheeks left after grinding, namely 60 and 62. By ensuring that the sum of the two wheel widths is just greater than this dimension, there is little risk of any unground material being left after the second plunge grind by the wheel 46.

In fact the two wheels 44 and 46 can be used to grind any region similar to 54 in which the distance between the two shoulders 60 and 62 can be anything between the width of the wider of the two wheels 44 and 46 up to the sum of the widths of the two grinding wheels. In this regard it will be seen that overlapping the two plain sections of the grinding wheels should not produce any additional unwanted grinding provided the two grinding wheels are advanced by the appropriate amount in each case.

If a general purpose machine is to be provided the two grinding wheels 44 and 46 should both be of the same width since this will give the greatest range of dimensions between shoulders 60 and 62.

Using two such wheels as in FIG. 4 may not allow ultimate optimisation of the grinding process, but where the same grinding material is utilised in the two wheels as is used on the single wheel of FIG. 3, the workpiece is of similar material, the same reduction in diameter and same axial extent of the workpiece is to be ground, a significant saving in cycle time has been obtained using two wheels to grind, as in FIG. 4, instead of a single wheel 28 as in FIG. 3, when using the same grinding machine and operating the latter at its maximum peak/and RMS power capability during each grinding process.

Figure 5:
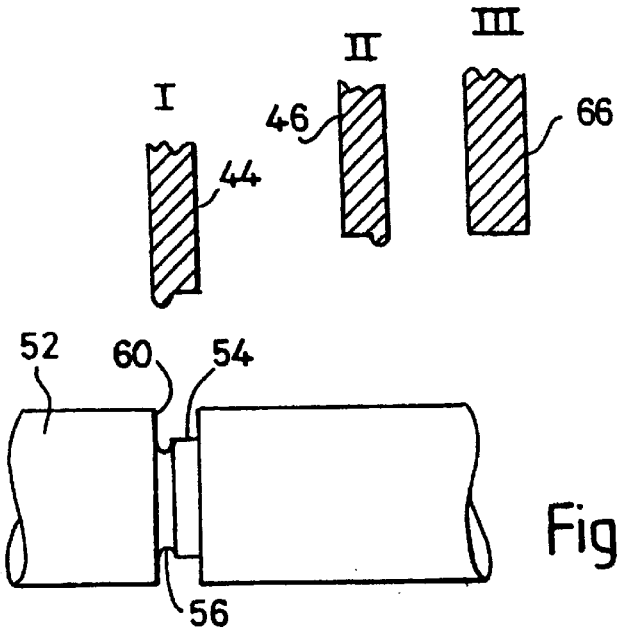
Figure 5:
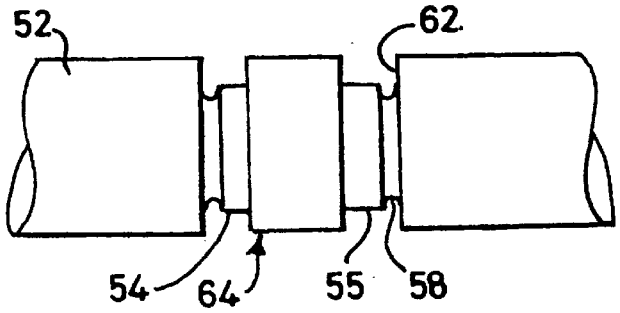
Figure 5:
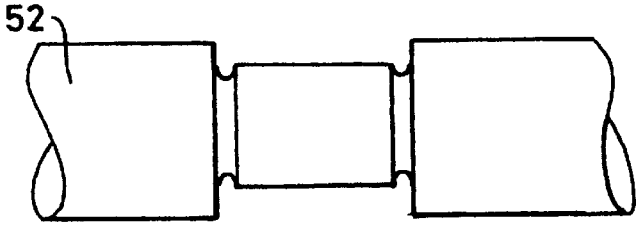

What has been found is that the narrower the wheel such as 44 and 46, the higher is the rate at which the wheel can be fed forward during the plunge grind mode. If the axial length of the region to be ground is such that half the axial length produces a relatively thick grinding wheel an advantage may be gained by adopting a method and technique such as shown in FIG. 5. This permits the narrowest possible wheels to be utilised taking into consideration rigidity and wheel strength as well as power capability. For simplicity the same reference numerals have been used to describe the grinding wheels described in relation to FIG. 4 and the workpiece is likewise identified by reference numeral 52.

In the FIG. 5 arrangement, a plunge grind using wheel 44 forms the shoulder 60 and the first region 54 with an undercut 56. Retraction and indexing (see FIG. 5B) allows the second grinding wheel 46 to plunge grind the second shoulder 62, and a second part of the reduced diameter region 54 which in FIG. 5B is denoted by 55. The edge profile on wheel 46 produces the second undercut 58. The difference between the FIG. 4 and FIG. 5 arrangements is that after the second plunge grind there exists an annular region 64 between the two regions 54 and 55, the outside diameter of which is commensurate with that of the workpiece 52.

If no further undercuts are required, neither of the wheels 44 and 46 can be used to remove this region.

To this end a third grinding wheel 66 is provided and after appropriate indexing (see FIG. 5(*c*)) to bring the workpiece region 64 into registry with the third wheel 66 (either by moving the workpiece relative to the wheel or the wheel relative to the workpiece, or both), the unwanted region 64 can be removed by plunge grinding using the third wheel 66. If the width of the latter is large enough a single plunge grind suitably located relative to the workpiece will remove the annulus of unwanted material 64. If as shown, the region 64 is of greater axial extent than the thickness of the wheel 66, two or more plunge grinds will be required. To even out wear on the wheel 66, the latter is preferably introduced in a given sequence which may have to be changed from one workpiece to the next. Thus for example the wheel 66 may be introduced at the left hand end of the region 64 first of all, and then the right hand end and then if any material still remains to be removed, it can be brought in centrally.

If the axial length of the region 64 is excessive, so that four or five or even more plunge grinds are required, these are preferably arranged so that an equal number involve one side and an equal number the other side of the wheel 66 so as to create a uniform wear pattern.

The invention is of particular application to grinding using CBN electroplated wheels. The grinding capability of such wheels has not been taken full advantage of hitherto. The wheel manufacturers specify a maximum material removal rate and it has been found that rarely is this rate achieved during grinding. In particular the motor power, particularly the RMS power of the motor driving the grinding wheel, limits the rate at which the wheel can be advanced and material removed. The RMS power capability of a motor is a measure of the continuous power requirements for the whole cycle and if the motor RMS power specification is exceeded the motor will overheat.

For electroplated wheels, the wheel specification is referred to in terms of specific metal removal rate (SMRR) and this is defined as the volume of metal removed per second, per millimetre wheel width, and forms the basis grinding power calculations. Wheel manufacturers suggest that the maximum SMRR for electroplate CBN wheels is 360 $mm^3$/mm.s when grinding cast iron and using neat oil as a coolant. However it is often the case that motor power limitations have limited wheel feed rates so that actually grinding is in the range 30 to 66 $mm^3$/mm.s. By incorporating the techniques proposed by the invention, much higher grinding rates than the 30 to 60 rate quoted above can be achieved which enables feed times to be greatly reduced. By reducing the width of the wheel, more plunges are required but the additional time required for indexing to present the wheel to different regions of, or different wheels to the workpiece, can be more than offset by the much shorter grinding times required for each plunge grind step.

As one example let us consider a four cylinder crankshaft in which the pins have to be ground from 50 mm to 40 mm, and the pins are each 23 mm wide. A work speed of 30 rpm has been assumed. The motor power specification is assumed to be 50 kilowatts maximum peak power and 30 kilowatts maximum RMS power.

Using a 23 mm wide wheel, and a single plunge method, the specific metal removal rate can be found to be 36.9 $mm^3$/mm.s (from a graph of SMRR vs specific power). Grinding time for the four pins is therefore 4×14 which equals 56 seconds. The time with the spindle running/coolant on is 5.1 seconds.

However to remain within the RMS power requirements of the motor, the feed rate has been reduced dramatically and the cycle time has to be at least 131.2 seconds.

Using two 12 mm wide wheels and two separate plunge grinds the specific metal removal rate for each wheel of 110.7 $mm^3$/mm.s is permissible (from the same graph of SMRR vs specific power). The total grinding time is now 4×2×6 which equals 48 seconds and the time with the spindle running and coolant is 10.1 seconds.

However in view of the lower RMS power requirements, the feed rate can be increased and the cycle time is now reduced to 63.3 seconds for the same maximum RMS power requirement.

It will be seen therefore that the cycle time has been approximately halved using a two-plunge method and the majority of the time saving can be attributed to the reduction in RMS power requirement since the higher feed rate during each plunge disproportionately compensates for the need to perform two plunges, and there no increase in cycle time to accommodate the lower RMS power capability.

FIG. 6 shows a grinding machine 68 having two grinding wheels 70, 72 driven by motors 74, 76 and mounted on wheelheads 78, 80 for movement towards and away from a workpiece 82 along linear tracks 84, 86 under the control of wheel feed drive motors 88, 90. The workpiece is mounted between centres in a tailstock 92 and a headstock 94 which also houses a motor (not shown) for rotating the workpiece 82 via a chuck 96. The workpiece shown is a crankshaft of an internal combustion engine and includes offset crankpins such as 98 which are to be ground to size, each of which constitutes a cylindrical workpiece for grinding.

A computer 100 running a programme to be described, controls the operation of the machine and inter alia moves the wheelheads 78, 80 towards and away from the workpiece 82 as the workpiece rotates, so as to maintain contact between the wheel and the crankpin being ground, as the latter rotates circularly around the axis of the workpiece centres.

A gauge, not shown, may be carried by the wheelhead assembly for in-process gauging the diameter of the crankpin as it is ground.

At 102 is mounted a hydraulically or pneumatically operated worksteady having a base 104 and movable cantilever arm 106 adapted at the right hand end as shown to engage a cylindrical journal bearing region of the crankshaft workpiece 82. Controlling signals for advancing and retracting 106 are derived from the computer 100.

At 108 and 110 are mounted two wheel diameter sensing gauges, signals from which are supplied back to the computer 100.

In FIG. 7 the workpiece is described diagrammatically at 110, mounted between footstock 112 and headstock 114 which is driven by workdrive motor 115. The workpiece is engaged by a grinding wheel 118 carried by a wheelhead 120 which is moved towards and away from the workpiece 110 by feed motor 122. The grinding wheel is rotated by a spindle drive motor 124.

Input data which is entered by an operator is shown on the left hand side of the diagram.

The grinding wheel cutting speed in revs/seconds is entered and stored at 126.

Grinding wheel spindle drive motor mechanism power capability is entered and stored (as a constant parameter) at 128.

Grinding wheel spindle drive motor maximum RMS power limit is entered and stored at 130. Again this will tend to be a constant parameter for the machine.

The maximum wheel feed to be attempted per workpiece revolution, during grinding and expressed as a % of the theoretical maximum, is entered and stored at 132.

Details of the coolant composition are entered and stored at 134.

Details of the material from which the grinding wheel is composed are entered and stored at 136.

Details of the workpiece material are entered and stored at 138.

The workpiece cutting speed in min/sec is entered and stored at 140.

From 134, 136 and 138 the specific material rate during grinding in cubic mm per m-s, is computed by programme step 142 and the removal rate is supplied to programme step 144 to compute the theoretical grinding wheel feed in mm per workpiece revolution.

Step 146 adjusts this to a lesser value depending on the % figure from 132 and using the rotational speed of the workpiece (in revs/second) from programme step 148 the grinding wheel feed rate is computed in step 150.

Control unit 152 serves to generate a control signal for motor 122 from the feed rate from 150.

The computed rotational speed from 148 is supplied to control unit 154 to generate a control signal for motor 146.

The grinding wheel cutting speed signal in rev/sec from 126 is converted by control unit 156 to a control signal for controlling the spindle drive motor 124, and a torque sensor (not shown) operates a feedback signal which is supplied together with the desired cutting speed in revs/second from 126, programme step 158 which computes the power required to achieve the speed of cutting and the RMS power being consumed. The instantaneous and RMS power values are compared with the stored values in 128 and 130 by programme steps 160, 162 and if either is exceeded a further reduction in feed rate per revolution is effected by programme step 146. This in turn reduces the wheel feed rate demand from 150 which reduces the demand made on motor 122, thereby reducing the wheelhead feed rate.

The control signal for motor 154 is obtained from the data in 140 and the workpiece radius obtained by gauging. Where this radius information is obtained by in process gauging, it is supplied along path 164 to programme step 148 together with the workpiece cutting speed information from 140, to modify the rotational speed control signal to be computed by step 48. In this way workpiece rotational speed is adjusted to accommodate the changing diameter of the workpiece and the latter is ground.

What is claimed is:

1. A method of reducing the time to grind a region of a workpiece having an axial length, comprising the steps of selecting a grinding wheel whose width is less than the axial length of said region and is a narrowest possible given a desired feed rate and an available maximum motive power, but being not substantially wider than is required by wheel strength, causing relative movement between the grinding wheel and the workpiece and performing at least two plunge grinding steps so as to grind said region, wherein at least two of said grinding wheels are provided and the said two at least grinding wheels simultaneously engage the workpiece for grinding, and performing a succession of at least two plunge grinding steps so as to grind the said region.

2. A method of grinding a workpiece wherein the wheel is selected in accordance with claim 1 and further comprising performing a plurality of plunge grinding steps with relative axial indexing between the wheel and the workpiece intermediate each plunge grinding step.

3. A method as claimed in claim 1, wherein some of the plunge grinds are performed using at least one other grinding wheel.

4. A method as claimed in claim 3, wherein two of said grinding wheels simultaneously engage the workpiece for grinding.

5. A method of grinding a region of a workpiece using a grinding wheel whose width is less than the axial extent of the region to be ground, so that more than one plunge grind is required to complete the grinding of the region, at least one of the additional plunge grinds required to completely grind the region being performed by a second grinding wheel or said at least two grinding wheels and wherein both wheels are selected using selection criteria required by claim 1.

6. A method of grinding as claimed in claim 5, wherein the workpiece region is cylindrical and is to have an annular shoulder at at least one end, adjacent which is to be ground an annular profile in the surface of the said region.

7. A method as claimed in claim 6, wherein two said annular profiles are to be generated, one at each end of the said region and the grinding is performed firstly by plunge grinding one end using a first narrow formed wheel, secondly by plunge grinding the other end using a second narrow formed wheel, and any further material remaining to be ground between the ends which have been ground by the first and second wheels is removed by at least one plunge grinds using at least one plain grinding wheel.

8. A method as claimed in claim 6, by which two undercuts are formed adjacent two annular shoulders at opposite ends of the cylindrical region, wherein a first grinding wheel having an appropriate formed grinding surface is engaged with one end of the said region so as to grind one undercut and surface grind part of the adjacent cylindrical region, and a second appropriate formed grinding wheel is engaged with the other end to grind the other undercut and the remainder of the cylindrical region between the two undercuts.

9. A method as claimed in claim 6, wherein at least one minimum width grinding wheel as defined by the criteria of claim 1 performs a plurality of plunge grinds to grind the cylindrical region between two shoulders in a first operation, and a profiled grinding wheel is employed to grind two undercuts as a second operation, the width of the profiled grinding wheel being not greater than the axial distance between the two shoulders and the diameter of the profiled grinding wheel being such that its surface between the two annular profiles which serve to grind the undercuts, makes no contact with the ground surface between the undercuts.

10. A method as claimed in claim 6, wherein during a first operation the width of material being ground is limited by the width of the grinding wheel but the cycle time is optimised using multiple plunge grinds with high metal removal rates, and during a second operation two undercuts are ground and the actual width of grinding wheel which is in contact with the workpiece is limited to the widths of the two annular grinding profiles which form the two undercuts, the rest of the wheel serving as a structural support for the two annular profiles, whereby the effective width of the wheel during the grinding of the undercuts is the sum as the widths of the two annular profiles producing the undercuts, whereby high metal removal rates are achieved, without overloading the power capability of the machine.

11. A method as claimed in claim 1, wherein the workpiece comprises a crankshaft and the region to be ground is a crankpin thereof.

12. A grinding machine which includes two narrow grinding wheels each selected in accordance with the size criteria of claim 1 mounted on a single spindle for simultaneous engagement with a workpiece to perform plunge grinds at accurately spaced apart positions on the workpiece.

13. Apparatus for grinding comprising a first grinding wheel having a profiled grinding surface, wheel dressing means associated therewith for dressing the grinding wheel as required to maintain the profile thereon, means for advancing and retracting the first grinding wheel towards and away from a rotatable workpiece so as to form an annular profile in the grinding surface and optionally to surface grind an adjacent region of the workpiece surface, a second grinding wheel mounted independently of the first grinding wheel, and adapted to be brought into engagement with the workpiece to grind an adjacent region of the workpiece surface within which the profile has been formed, by at least one plunge grind, wherein at least one of said grinding wheels is selected in accordance with the criteria of claim 1.

14. Apparatus as claimed in claim 13, further comprising a workrest for engaging the workpiece during grinding, to resist bending of the workpiece under the grinding forces.

15. A method of grinding a region of a workpiece between first and second shoulders having an axial distance therebetween, comprising the steps of selecting a grinding wheel whose width is less than the axial distance between the shoulders, plunge grinding adjacent one of the shoulders, causing relative axial indexing between the wheel and the workpiece, plunge grinding adjacent the other shoulder, and thereafter removing any unground material remaining between the two shoulders by performing at least three plunge grinding steps with appropriate indexing, wherein the indexing is such that one side of the wheel is presented with unground material substantially the same number of times in the sequence of additional plunge grinds as is the other side of the wheel.

16. A method of grinding an axial region of a workpiece using a grinding wheel which is rotatable by a drive motor and is mounted on a wheelhead and whose width is not substantially greater than that dictated by structural and strength requirements, comprising the steps of programming an indexing drive means of one of the wheelhead and the workpiece to enable the relative positions of the wheelhead and workpiece to be adjusted in a sequence of steps to achieve a sequence of plunge grinds and enable the said axial region of the workpiece to be ground, said axial region having an extent greater than the width of the wheel, programming a computer based machine control system to generate control signals for controlling the rate of wheelfeed during grinding dependent on feedback signals during grinding, entering data into data stores associated with the control system relating to maximum instantaneous and RMS power of the drive motor, and controlling the wheel feed rate by the control system to enable a feed rate to be achieved limited only by peak and RMS power capabilities of the wheel spindle drive motor, so that the rate of material removal is as high as is compatible with the power capabilities of the machine during each plunge, thereby optimizing the total cycle time for grinding, wherein the feedback signals enable each of the instantaneous, and RMS, wheel spindle motor power to be calculated as grinding progresses.

17. A method as claimed in claim 16, wherein the wheel feed programming includes the steps of inputting parameter comprising at least one of grinding wheel material, workpiece material, workpiece cutting speed, coolant composition, grinding wheel feed per workpiece revolution limit, maximum instantaneous and RMS wheel spindle drive motor power, and grinding wheel cutting speed.

18. A grinding machine comprising a single wheelhead having mounted thereon a grinding wheel whose width is not substantially greater than that dictated by structural and strength requirements, programmable indexing means to enable the relative positions of the wheelhead and workpiece to be adjusted in a sequence of steps to achieve a sequence of plunge grinds, to enable a region of the workpiece to be ground, the axial extent of which is greater than the width of the wheel, wheel feed means, control means by which the feed rate is controlled, and wherein the wheel feed rate is programmable to enable a feed rate to be selected dependent on the peak and RMS power capabilities of the wheel drive, so that the rate of material removal is as high as is compatible with the power capabilities of the machine during each plunge, thereby optimising the total cycle time for grinding.

19. A machine as claimed in claim 18, wherein the machine is fitted with wheel diameter sensing means and feedback control means for adjusting the wheel feed and wheel feed rate accordingly.

* * * * *